US011340647B2

(12) United States Patent
Tomiyama

(10) Patent No.: US 11,340,647 B2
(45) Date of Patent: May 24, 2022

(54) REFERENCE VOLTAGE GENERATION CIRCUIT

(71) Applicant: SONY SEMICONDUCTOR SOLUTIONS CORPORATION, Kanagawa (JP)

(72) Inventor: Hitoshi Tomiyama, Kanagawa (JP)

(73) Assignee: SONY SEMICONDUCTOR SOLUTIONS CORPORATION, Kanagawa (JP)

( * ) Notice: Subject to any disclaimer, the term of this patent is extended or adjusted under 35 U.S.C. 154(b) by 0 days.

(21) Appl. No.: 16/968,698

(22) PCT Filed: Nov. 7, 2018

(86) PCT No.: PCT/JP2018/041273
§ 371 (c)(1),
(2) Date: Aug. 10, 2020

(87) PCT Pub. No.: WO2019/159445
PCT Pub. Date: Aug. 22, 2019

(65) Prior Publication Data

US 2020/0379497 A1 Dec. 3, 2020

(30) Foreign Application Priority Data

Feb. 16, 2018 (JP) ..... JP2018-026277

(51) Int. Cl.
*G05F 3/24* (2006.01)
*G05F 1/575* (2006.01)

(52) U.S. Cl.
CPC ..... *G05F 3/24* (2013.01); *G05F 1/575* (2013.01)

(58) Field of Classification Search
CPC ..... G05F 3/24; G05F 1/575
See application file for complete search history.

(56) References Cited

U.S. PATENT DOCUMENTS 5,119,015 A * 6/1992 Watanabe ..... G05F 3/30 323/313
2002/0079876 A1 6/2002 Eguchi
2014/0132241 A1 5/2014 Fukazawa et al.

FOREIGN PATENT DOCUMENTS

JP 03-242715 A 10/1991
JP 2002-149252 A 5/2002
JP 2008-251055 A 10/2008
JP 2014-098984 A 5/2014

OTHER PUBLICATIONS

International Search Report and Written Opinion of PCT Application No. PCT/JP2018/041273, dated Jan. 22, 2019, 06 pages of ISRWO.

* cited by examiner

*Primary Examiner* — Jue Zhang
(74) *Attorney, Agent, or Firm* — Chip Law Group

(57) ABSTRACT

A noise component of a reference voltage is reduced in a circuit that generates a constant reference voltage that does not depend on a power supply voltage or a temperature. A reference voltage generation circuit includes a transistor, a first resistor, a diode, a second resistor, and a control unit. One of both ends of the transistor is connected to an output signal line. The first resistor is connected to another end of the transistor. Both ends of the second resistor are connected to one end of the diode and the output signal line. The control unit controls a potential of the another end of the transistor and a potential of the one end of the diode to the same potential.

8 Claims, 8 Drawing Sheets

REFERENCE VOLTAGE GENERATION CIRCUIT

CROSS REFERENCE TO RELATED APPLICATIONS

This application is a U.S. National Phase of International Patent Application No. PCT/JP2018/041273 filed on Nov. 7, 2018, which claims priority benefit of Japanese Patent Application No. JP 2018-026277 filed in the Japan Patent Office on Feb. 16, 2018. Each of the above-referenced applications is hereby incorporated herein by reference in its entirety.

TECHNICAL FIELD

The present technology relates to a reference voltage generation circuit. More specifically, the present technology relates to a reference voltage generation circuit that generates a constant voltage.

BACKGROUND ART

Conventionally, in various electronic devices, a band gap reference (BGR) circuit has been used to generate a constant voltage. For example, a BGR circuit in which a resistor, a diode, and an operational amplifier are arranged is proposed (for example, see Patent Document 1). In this BGR circuit, a resistor is inserted between an inverting input terminal (−) of the operational amplifier and a signal line that outputs a reference voltage, and a plurality of diodes connected in parallel with the resistor is inserted between the inverting input terminal (−) and a ground terminal.

CITATION LIST

Patent Document

Patent Document 1: Japanese Patent Application Laid-Open No. 2008-251055

SUMMARY OF THE INVENTION

Problems to be Solved by the Invention

In the above related art, a constant voltage that does not depend on a power supply voltage or a temperature can be generated as a reference voltage. However, in the above BGR circuit, when a value of a resistor on the signal line side is denoted by Rc and a value of a resistor on the ground terminal side is denoted by $R_{BGR}$, it is necessary to satisfy the following relational expression in order to realize temperature compensation.

$$R_C/R_{BGR}=23.188/\log_e(m) \quad \text{Expression 1}$$

In the above expression, m denotes an integer and indicates the number of diodes connected in parallel. $\log_e(\ )$ denotes a function that returns a natural logarithm.

In addition, as a ratio $R_C/R_{BGR}$ expressed by Expression 1 is larger, a gain with respect to noise generated inside the BGR circuit is increased, and there is a problem that a noise component in the reference voltage is increased.

The present technology has been made in view of such a circumstance, and an object thereof is to reduce a noise component of a reference voltage in a circuit that generates a constant reference voltage that does not depend on a power supply voltage or a temperature.

Solutions to Problems

The present technology has been made to solve the above problem, and a first aspect thereof is a reference voltage generation circuit including: a diode; a first resistor having both ends connected to one end of the diode and an output signal line; a transistor having one of both ends connected to the output signal line; a second resistor connected to another end of the transistor; and a control unit that controls a potential of the another end of the transistor and a potential of the one end of the diode to the same potential. With this configuration, it is possible to generate a reference voltage in which a noise component is suppressed.

Further, in the first aspect, a ratio of a resistance value of the second resistor to a resistance value of an on-resistor of the transistor may substantially match a ratio of a reference voltage that is a voltage of the output signal line to a difference between the reference voltage and a forward voltage of the diode. With this configuration, noise can be amplified by a gain corresponding to the ratio of the reference voltage to the difference between the reference voltage and the forward voltage.

Further, in the first aspect, the transistor may have a resistance value of an on-resistor that increases as a temperature increases. With this configuration, it is possible to generate a reference voltage that does not depend on a temperature.

Further, in the first aspect, a gate-source voltage of the transistor may be a voltage in a linear region. With this configuration, temperature compensation can be performed by the transistor in the linear region.

Further, in the first aspect, a predetermined number of the transistors may be connected in parallel between the output signal line and the second resistor. With this configuration, it is possible to adjust combined resistance of the transistors.

Further, the first aspect may further include a switch circuit that controls a specified transistor among the predetermined number of the transistors to an on state. With this configuration, it is possible to generate a reference voltage corresponding to combined resistance of the on-state transistors.

Effects of the Invention

The present technology can have an excellent effect of reducing a noise component of a reference voltage in a circuit that generates a constant reference voltage that does not depend on a power supply voltage or a temperature. Note that the effect described herein is not necessarily limited, and may be any of the effects described in the present disclosure.

MODE FOR CARRYING OUT THE INVENTION

Hereinafter, modes for carrying out the present technology (hereinafter, referred to as "embodiments") will be described. Description will be made in the following order.

1. First embodiment (an example of connecting a connection node between a transistor and a resistor to an operational amplifier)
2. Second embodiment (an example of connecting a connection node between a plurality of transistors connected in parallel and a resistor to an operational amplifier)
3. Application examples

1. First Embodiment

Configuration Example of Electronic Device

Figure 1:
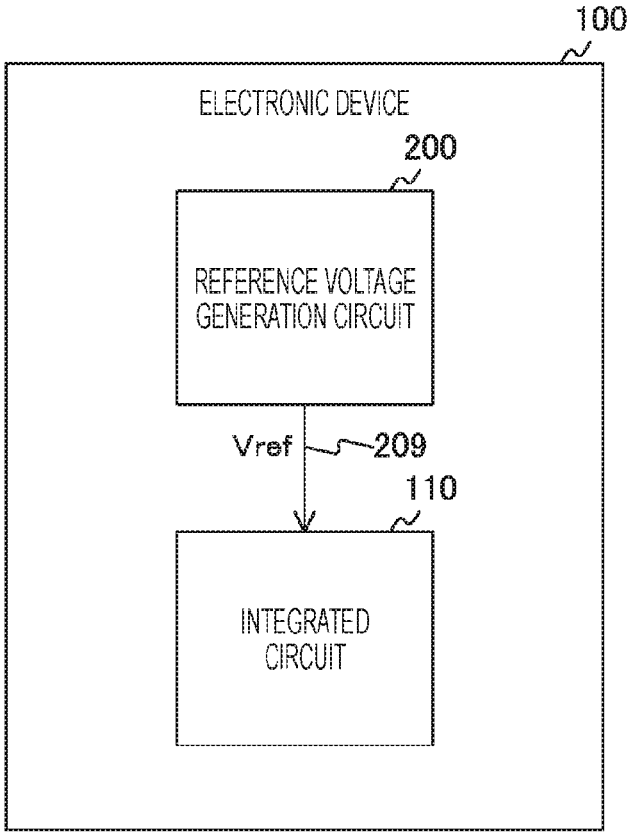
FIG. 1 is a block diagram illustrating a configuration example of an electronic device according to a first embodiment of the present technology.

FIG. 1 is a block diagram illustrating a configuration example of an electronic device 100 according to a first embodiment of the present technology. The electronic device 100 includes a reference voltage generation circuit 200 and an integrated circuit 110. The electronic device 100 is assumed to be an audio device, a smartphone, a communication device, or the like.

The reference voltage generation circuit 200 generates a constant voltage that does not depend on a power supply voltage or a temperature as a reference voltage Vref. The reference voltage generation circuit 200 supplies the generated voltage to the integrated circuit 110 via an output signal line 209. The integrated circuit 110 is driven by the reference voltage Vref, and executes predetermined processing such as arithmetic processing.

Configuration Example of Reference Voltage Generation Circuit

Figure 2:
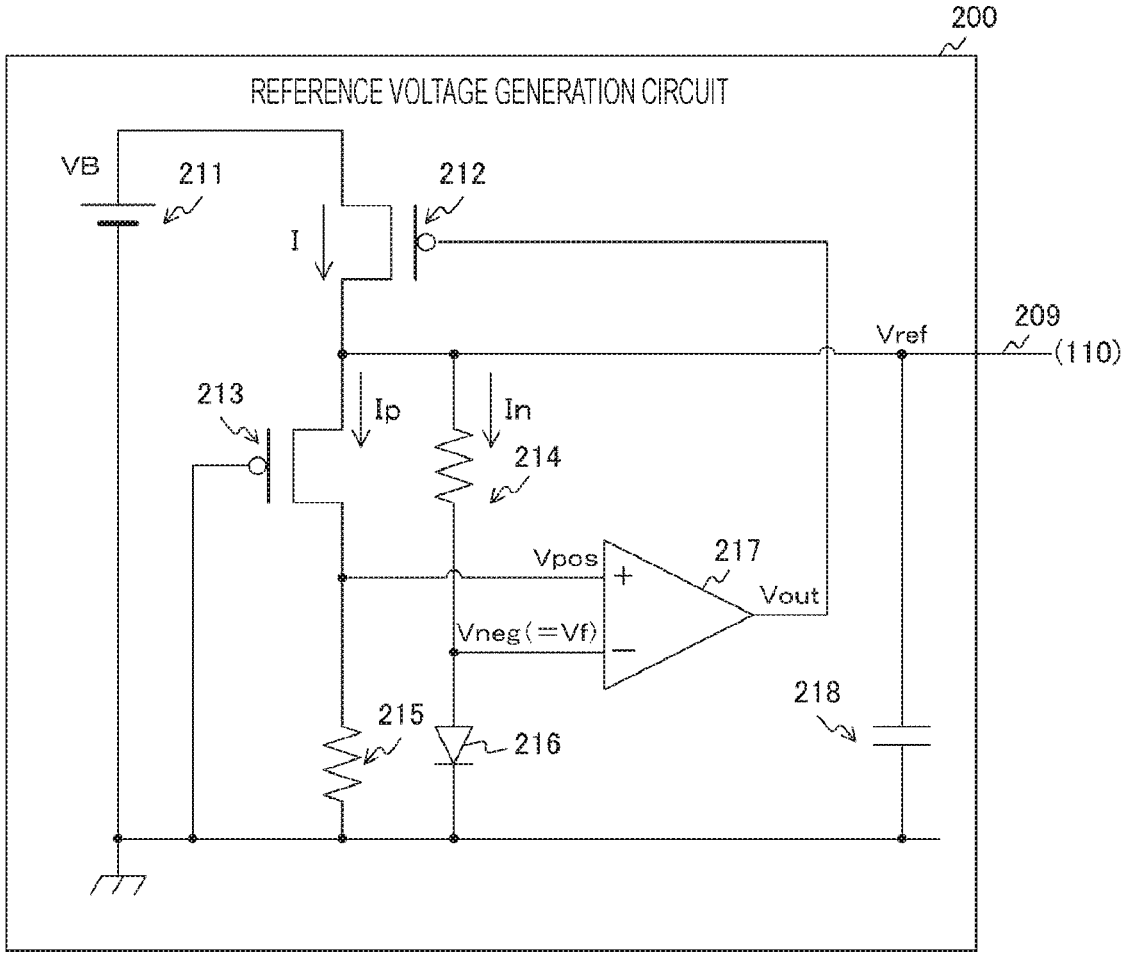
FIG. 2 is a circuit diagram illustrating a configuration example of a reference voltage generation circuit according to the first embodiment of the present technology.

FIG. 2 is a circuit diagram illustrating a configuration example of the reference voltage generation circuit 200 according to the first embodiment of the present technology. The reference voltage generation circuit 200 includes a power supply 211, p-type transistors 212 and 213, resistors 214 and 215, a diode 216, an operational amplifier 217, and a capacitor 218. The p-type transistors 212 and 213 are, for example, metal-oxide-semiconductor (MOS) transistors.

The power supply 211 supplies a power supply voltage VB. The p-type transistors 212 and 213 and the resistor 215 are connected in series between a power supply terminal of the power supply 211 and a ground terminal having a potential lower than that of the power supply terminal.

Further, a gate of the p-type transistor 212 is connected to an output terminal of the operational amplifier 217, and a gate of the p-type transistor 213 is connected to the ground terminal. A connection node between the p-type transistors 212 and 213 is connected to the output signal line 209, and a connection node between the p-type transistor 213 and the resistor 215 is connected to a non-inverting input terminal (+) of the operational amplifier 217. Between both ends (source and drain) of the p-type transistor 213, the source is connected to the output signal line 209, and the drain is connected to the resistor 215. Note that the resistor 215 is an example of a second resistor recited in the claims.

A gate-source voltage of the p-type transistor 213 is the sum of the power supply voltage VB and a drain-source voltage of the p-type transistor 212. In addition, the power supply voltage VB is sufficiently high, and thus the gate-source voltage of the p-type transistor 213 is a voltage in a linear region. Herein, the linear region means a region in which a drain current is proportional to the drain-source voltage. Meanwhile, a region in which the drain current is saturated with respect to an increase in the drain-source voltage is referred to as "saturated region". Note that the p-type transistor 213 is an example of a transistor recited in the claims.

Further, the resistor 214 and the diode 216 are connected in series between the output signal line 209 and the ground terminal. A connection node between the resistor 214 and the diode 216 is connected to an inverting input terminal (−) of the operational amplifier 217. A cathode of the diode 216 is connected to the ground terminal, and an anode thereof is connected to the resistor 214. The capacitor 218 is inserted between the output signal line 209 and the ground terminal. Note that the resistor 214 is an example of a first resistor recited in the claims.

The operational amplifier 217 outputs, from the output terminal, a voltage corresponding to a potential difference between the non-inverting input terminal (+) and the inverting input terminal (−). When a potential of the non-inverting input terminal (+) is denoted by Vpos and a potential of the inverting input terminal (−) is denoted by Vneg, an output voltage Vout of the output terminal is expressed by the following expression.

$$V\text{out}=A(V\text{pos}-V\text{neg}) \qquad \text{Expression 2}$$

In the above expression, A denotes a gain of the operational amplifier 217.

The operational amplifier 217 supplies the output voltage Vout in Expression 2 to the p-type transistor 212, and the p-type transistor 212 supplies a current I corresponding to the voltage. The current I is divided into currents Ip and In at a predetermined dividing ratio. The current Ip is supplied to the p-type transistor 213 and the resistor 215, and the current In is supplied to the resistor 214 and the diode 216.

A resistance value of an on-resistor of the p-type transistor 213 is denoted by Rds, and a forward voltage of the diode 216 is denoted by Vf. Further, a resistance value of the resistor 214 is denoted by R1, and a resistance value of the resistor 215 is denoted by R2. At this time, the potential Vpos is expressed by the following expression.

$$V\text{pos}=Ip\times R2 \qquad \text{Expression 3}$$

Meanwhile, the potential Vneg is equal to the forward voltage Vf. According to Expression 3, the potential Vpos fluctuates depending on the current, whereas the potential Vneg (that is, the forward voltage Vf) hardly fluctuates. In a case where the potential Vpos is higher than the potential Vneg, the output voltage Vout increases and the current I decreases according to Expression 2. As the current I decreases, the current Ip also decreases, and the potential Vpos decreases according to Expression 3. This reduces a potential difference between the potential Vpos and the potential Vneg.

Meanwhile, in a case where the potential Vpos is lower than the potential Vneg, the output voltage Vout decreases and the current I increases according to Expression 2. As the current I increases, the current Ip also increases, and the potential Vpos increases according to Expression 3. This reduces the potential difference between the potential Vpos and the potential Vneg. Thus, the potential Vpos and the potential Vneg are controlled to the same value by the p-type transistor 212 and the operational amplifier 217. Note that a circuit including the p-type transistor 212 and the operational amplifier 217 is an example of a control unit recited in the claims.

Further, the reference voltage Vref generated in the output signal line 209 is expressed by the following expression.

$$Vref=R1\times In+Vf \quad \text{Expression 4}$$

Further, when the potential Vpos and the potential Vneg are the same, the following expression is established.

$$Rds\times Ip=R1\times In \quad \text{Expression 5}$$

By substituting Expression 5 into Expression 4, the following expression is obtained.

$$Vref=Rds\times Ip+Vf \quad \text{Expression 6}$$

The following expression is obtained from Expressions 3 and 6.

$$Vref=(Rds/R2)\times Vpos+Vf \quad \text{Expression 7}$$

When the potential Vpos and the potential Vneg are the same, the potential Vpos is the same as the forward voltage Vf. Therefore, Expression 7 can be replaced with the following expression.

$$Vref=(Rds/R2)\times Vf+Vf \quad \text{Expression 8}$$

The resistance value Rds and the forward voltage Vf are substantially constant when the temperature is constant. Therefore, according to Expression 8, the reference voltage Vref is a constant voltage that does not depend on the power supply voltage VB.

Next, temperature-dependent characteristics will be described. A drain current Ids of a p-type MOS transistor such as the p-type transistor 213 is generally expressed by the following expression.

$$Ids=u_n\times Cox(W/L)\times\{(Vgs-V_{TH}-Vds/2)Vds\} \quad \text{Expression 9}$$

In the above expression, $u_n$ denotes mobility of electrons, and a unit thereof is, for example, square meters per volt per second ($m^2/V\cdot s$). Cox denotes an oxide film capacitance per unit area, and a unit thereof is, for example, Farad per square centimeter ($F/cm^2$). W denotes a gate width, and L denotes a gate length. Units thereof are, for example, meter (m). Vgs denotes a gate-source voltage, and $V_{TH}$ denotes a threshold voltage. Vds denotes a drain-source voltage. Units of those voltages are, for example, volt (V).

In Expression 9, it is known that the mobility $u_n$ has a characteristic that decreases as the temperature increases, in other words, has a negative temperature characteristic. Meanwhile, it is known that the threshold voltage $V_{TH}$ has a characteristic that increases as the temperature increases, in other words, has a positive temperature characteristic. In addition, in the linear region, the temperature characteristic of the mobility $u_n$ becomes dominant as compared with the temperature characteristic of the threshold voltage $V_{TH}$. The p-type transistor 213 is in the linear region as described above, and thus the drain current Ids (that is, Ip) of the p-type transistor 213 has a negative temperature characteristic. That is, the resistance value Rds of the on-resistor of the p-type transistor 213 has a positive temperature characteristic.

In addition, in Expression 8, the resistance value Rds has a positive temperature characteristic, whereas the forward voltage Vf has a negative temperature characteristic. Actual values of those temperature characteristics depend on the kind of the p-type transistor 213 and the diode 216, impurity concentration, and the like. By adjusting parameters such as the impurity concentration so that those temperature characteristics offset each other, the reference voltage Vref can be kept constant regardless of the temperature. For example, when the forward voltage Vf fluctuates by −2 millivolts (mV) each time when the temperature rises by one degree, it is only necessary to adjust the drain-source voltage of the p-type transistor 213 so that the drain-source voltage fluctuates by +2 millivolts (mV) each time when the temperature rises by one degree. This makes it possible to realize temperature compensation, and the reference voltage generation circuit 200 can generate a constant reference voltage Vref that does not depend on the power supply voltage or the temperature.

Note that, although the p-type transistor 213 is arranged, an n-type transistor can be arranged instead. In this case, it is only necessary to supply a voltage in the linear region between a gate and a source of the n-type transistor.

Figure 3:
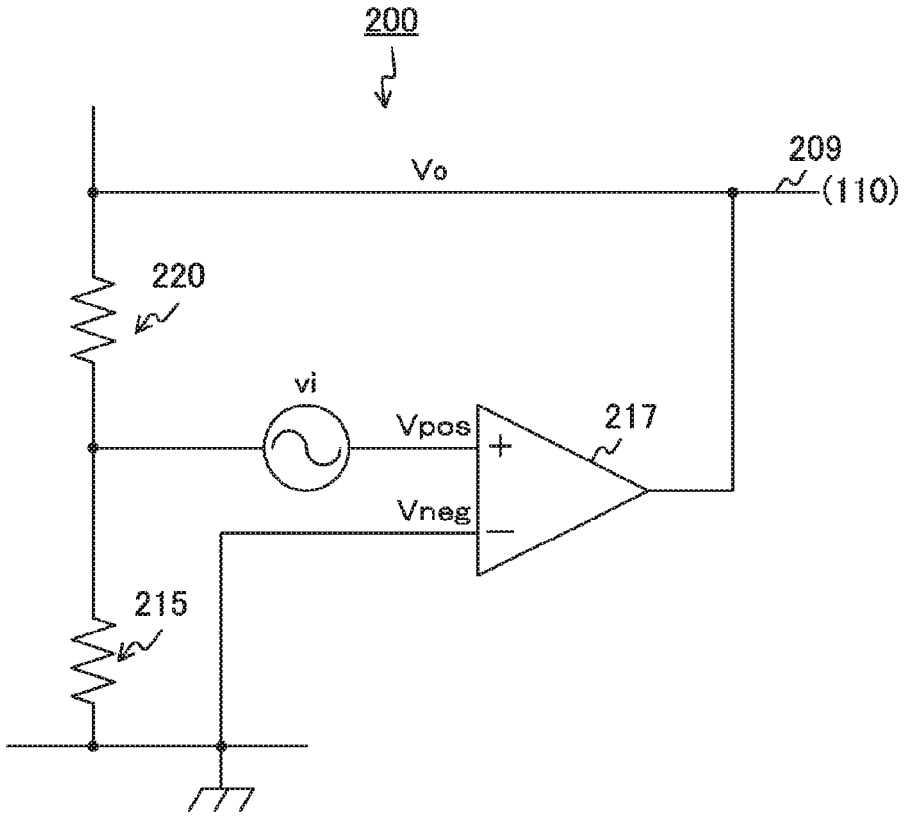
FIG. 3 illustrates an example of an equivalent circuit of the reference voltage generation circuit according to the first embodiment of the present technology.

FIG. 3 illustrates an example of an equivalent circuit of the reference voltage generation circuit 200 according to the first embodiment of the present technology. In FIG. 3, the p-type transistor 213 is replaced with a resistor 220, and the power supply 211, the p-type transistor 212, the resistor 214, the diode 216, and the capacitor 218 are omitted.

As described above, the operational amplifier 217 controls the potential Vpos and the potential Vneg to the same potential. With this control, the potential Vpos fluctuates, and a fluctuation component thereof is treated as noise. When this noise component is an AC component vi, an output voltage Vo generated by the AC component vi can be expressed by the following expression. The output voltage Vo corresponds to a level of the noise component in the reference voltage Vref.

$$Vo=vi\times(Rds+R2)/R2 \quad \text{Expression 10}$$

From Expression 10, a gain G for amplifying noise is expressed by the following expression.

$$G=Vo/Vi=(Rds+R2)/R2 \quad \text{Expression 11}$$

According to Expression 11, as the resistance value Rds is smaller than the resistance value R2, the gain G for amplifying noise becomes smaller, and signal quality of the reference voltage Vref is improved.

Herein, the following expression is obtained by transforming Expression 8.

$$Rds/R2=(Vref-Vf)/Vf \quad \text{Expression 12}$$

Herein, the reference voltage Vref is higher than the forward voltage Vf according to Expression 6, and thus a ratio in the left side of Expression 12 is smaller than 1.

Meanwhile, in a general BGR circuit, a resistor is inserted instead of the p-type transistor 213, and a plurality of diodes connected in parallel with the resistor is inserted instead of the resistor 215. Then, when a resistance value of the resistor on the signal line side is denoted by Rc and a resistance value on the ground terminal side is denoted by $R_{BGR}$ in this configuration, it is necessary to satisfy Expression 1 in order to realize temperature compensation. A method of deriving Expression 1 is described in, for example, 'Mitsuo Misaizu, "The 34th Analog ABC (Analog technology basic course)", Oct. 10, 2011, ITmedia, Internet (http://eetimes.jp/ee/articles/1111/10/news005_2.html)'.

In Expression 1, the resistance value Rc corresponds to the resistance value Rds, and the resistance value $R_{BGR}$ corresponds to the resistance value R2. Therefore, Expression 1 is replaced with the following expression for comparison.

$$Rds/R2=23.188/\log_e(m) \quad \text{Expression 13}$$

When m is extremely increased, it is theoretically possible to make the left side of Expression 13 less than 1. However, a denominator on the right side is a natural logarithm of m, and thus a huge number of diodes (m) are required to make the left side less than 1, which is not practical. For example, when m is "15" (pieces), the left side is 8.563, which is 1 or more in a practical configuration.

Note that, if m is zero, that is, if the diodes are eliminated, there is no need to satisfy Expression 13. Thus, it is possible to reduce the noise component by setting a ratio of the resistances to 1 or less. However, this configuration is not preferable because temperature compensation cannot be performed. Further, the noise component can also be reduced also by adding an external capacitor. However, it is necessary to increase capacitance as a frequency decreases. This increases a circuit area, which is not preferable.

Meanwhile, because the reference voltage Vref is higher than the forward voltage Vf in the reference voltage generation circuit 200 as described above, the ratio of the resistances in Expression 12 becomes less than 1, which is much smaller than the ratio in Expression 13. Therefore, according to Expression 11, the gain G for amplifying noise is reduced. This makes it possible to reduce the noise component in the reference voltage Vref that does not depend on the power supply voltage or the temperature.

Specifically, for example, in a case where the reference voltage Vref is 1.2 volts (V) and the forward voltage Vf is 0.7 volts (V), the resistance values Rds and R2 that satisfy Expression 12 are, for example, 10 kiloohms (kΩ)) and 14 kiloohms (kΩ)). In this case, the gain G is "12/7" according to Expression 11. Meanwhile, in a general BGR circuit, the resistance values Rds and R2 that satisfy Expression 13 are, for example, 23 kiloohms (kΩ)) and 3 kiloohms (kΩ)). In this case, the gain G is "26/3" according to Expression 11, and thus the gain G with respect to noise is larger than that of the reference voltage generation circuit 200.

Figure 4:
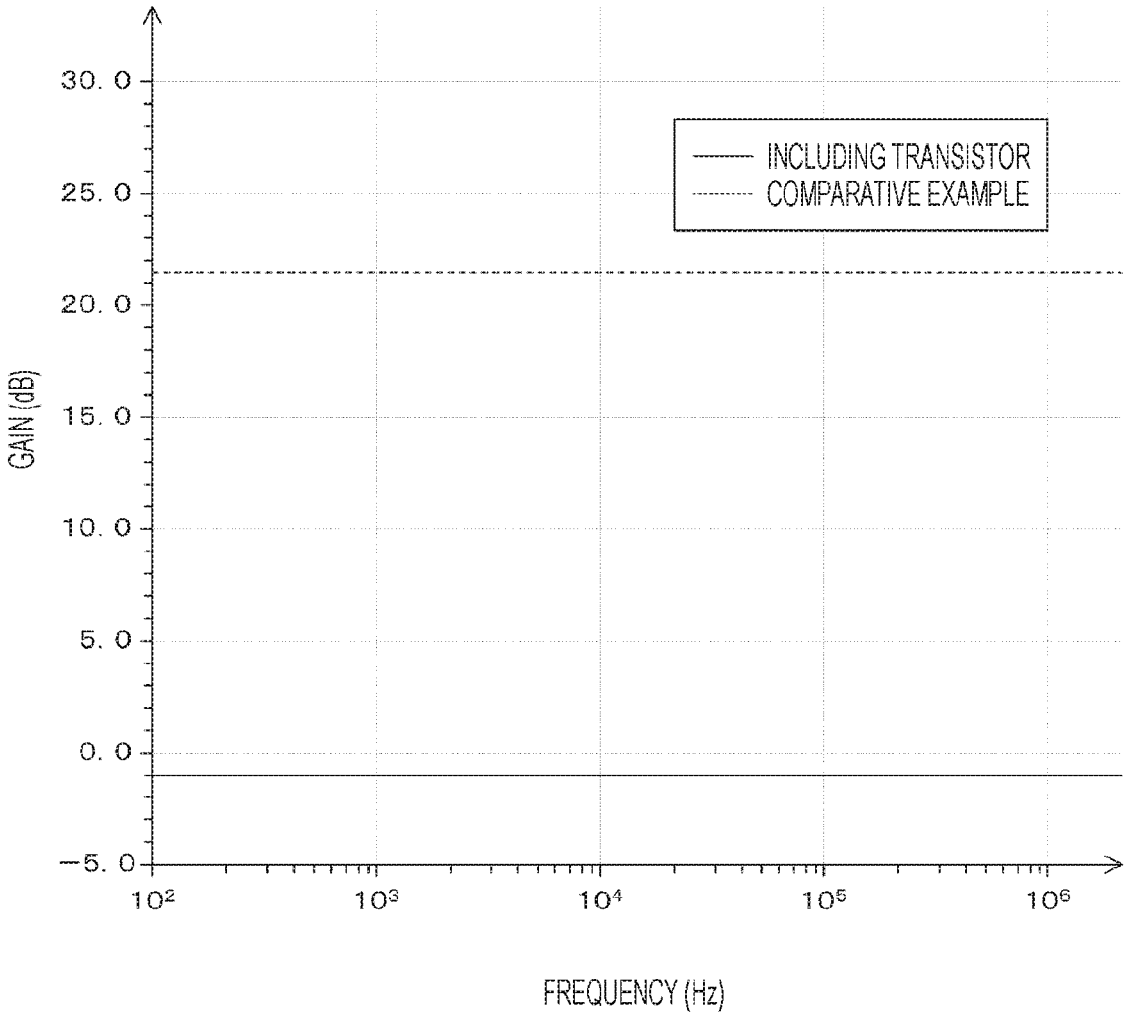
FIG. 4 is a graph showing an example of gain characteristics according to the first embodiment of the present technology.

FIG. 4 is a graph showing an example of gain characteristics according to the first embodiment of the present technology. A vertical axis in FIG. 4 shows a gain with respect to noise, and a horizontal axis therein shows a frequency. Further, a solid line shows an example of a gain of the reference voltage generation circuit 200 including the p-type transistor 213, and a dotted line shows an example of a gain of a general BGR circuit including no transistor in a comparative example. As shown in FIG. 4, the gain with respect to noise is reduced in the reference voltage generation circuit 200.

Figure 5:
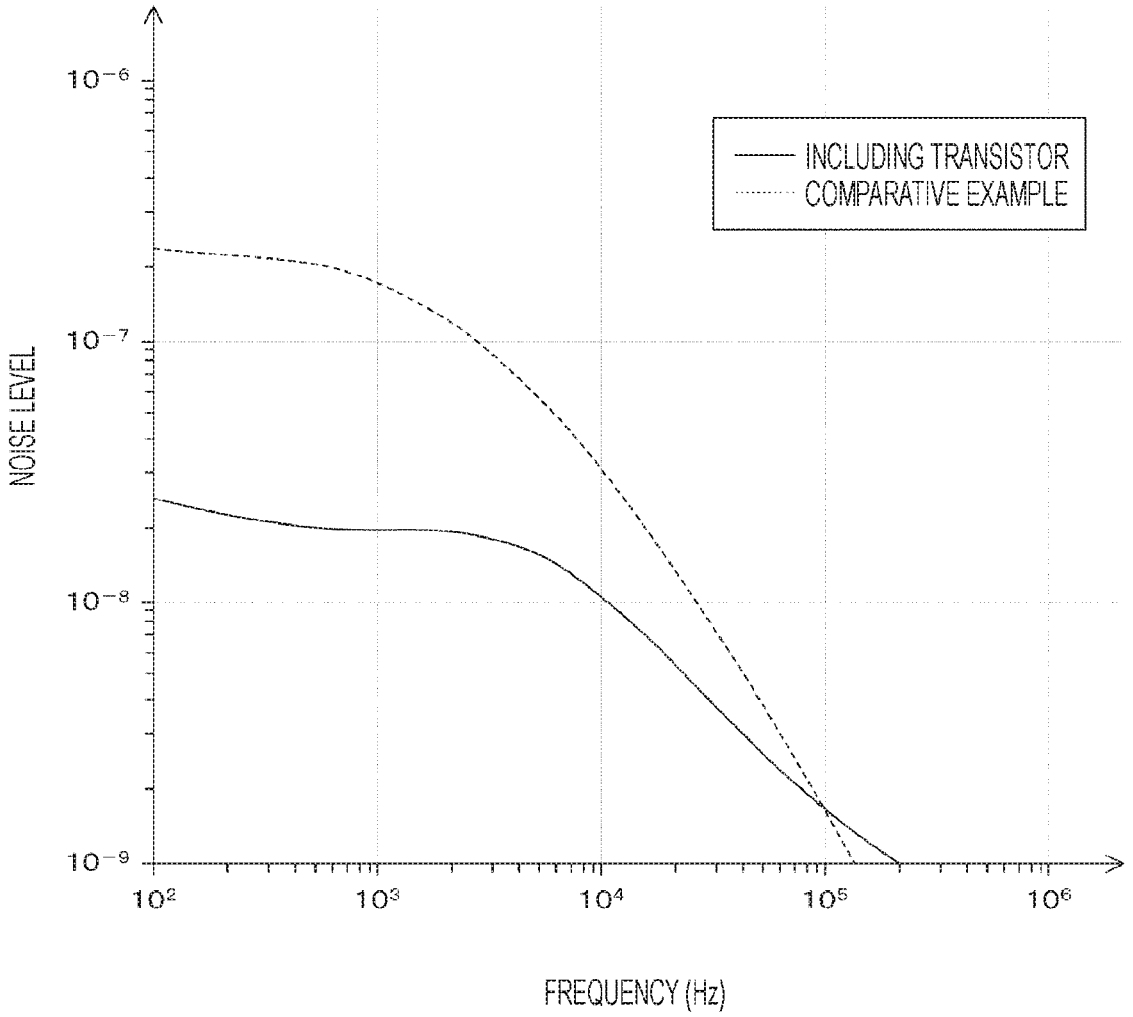
FIG. 5 is a graph showing an example of noise characteristics according to the first embodiment of the present technology.

FIG. 5 is a graph showing an example of noise characteristics according to the first embodiment of the present technology. A vertical axis in FIG. 5 shows a noise level at the reference voltage Vref, and a horizontal axis therein shows a frequency. Further, a solid line shows an example of a noise characteristic of the reference voltage generation circuit 200 including the p-type transistor 213, and a dotted line shows an example of a noise characteristic in the comparative example. As shown in FIG. 5, the gain with respect to noise is small in the reference voltage generation circuit 200, and thus the noise level at the reference voltage Vref is low.

As described above, according to the first embodiment of the present technology, the connection node between the p-type transistor 213 and the resistor 215 connected in series is connected to the input terminal of the operational amplifier 217. This makes it possible to reduce the gain with respect to noise generated in the reference voltage generation circuit 200. This makes it possible to reduce the noise component in the reference voltage Vref.

2. Second Embodiment

In the above first embodiment, only a single p-type transistor 213 is arranged. However, there is a possibility that a reference voltage Vref deviates from a design value due to product variation between on-resistors. A reference voltage generation circuit 200 according to a second embodiment is different from that according to the first embodiment in that a plurality of p-type transistors is connected in parallel to adjust combined resistance thereof.

Figure 6:
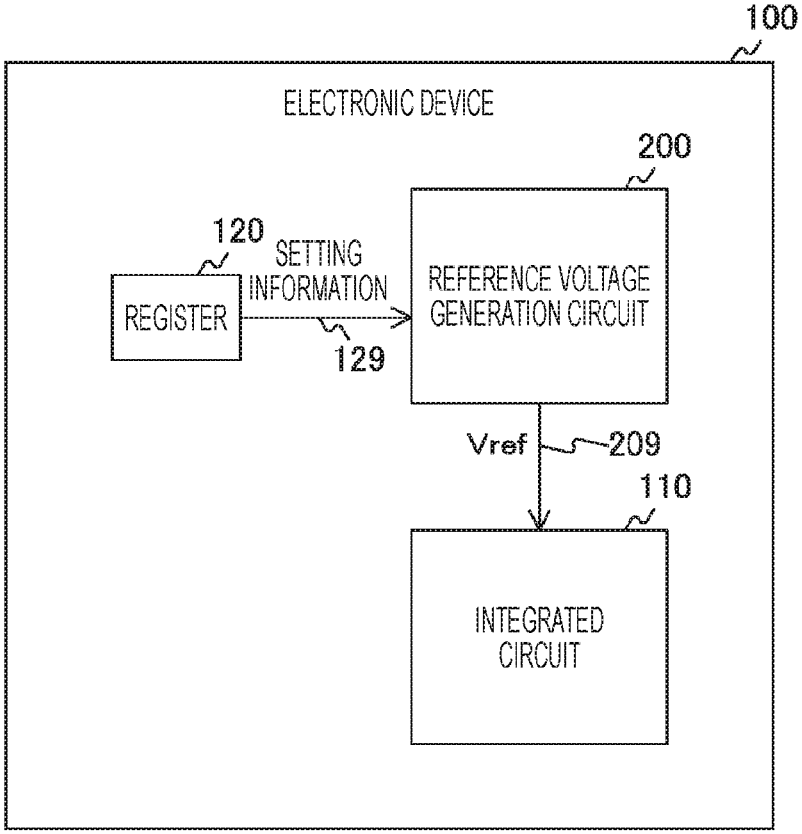
FIG. 6 is a block diagram illustrating a configuration example of an electronic device according to a second embodiment of the present technology.

FIG. 6 is a block diagram illustrating a configuration example of an electronic device 100 according to the second embodiment of the present technology. The electronic device 100 according to the second embodiment is different from that according to the first embodiment in further including a register 120. Details of information held in the register 120 will be described later.

Figure 7:
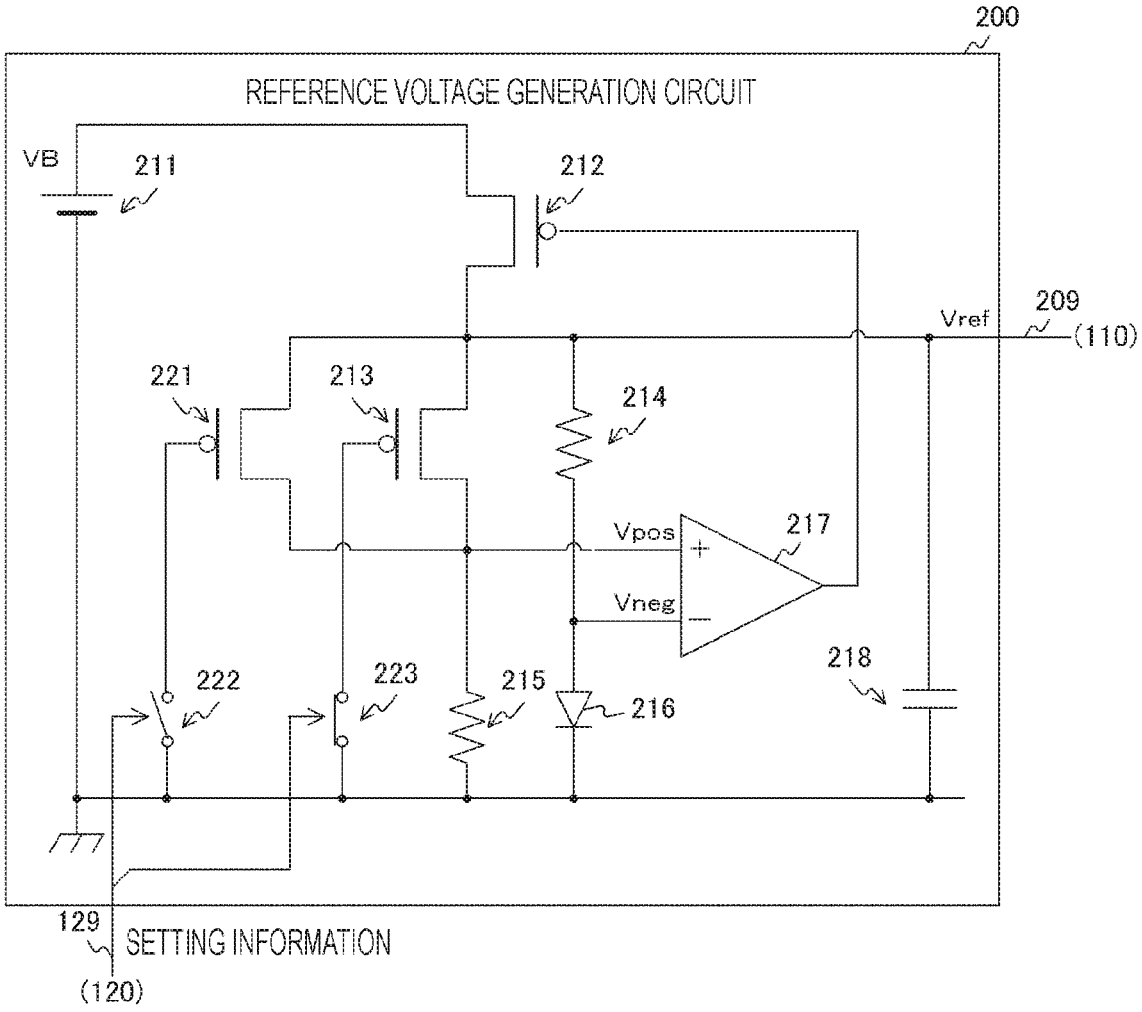
FIG. 7 is a circuit diagram illustrating a configuration example of a reference voltage generation circuit according to the second embodiment of the present technology.

FIG. 7 is a circuit diagram illustrating a configuration example of the reference voltage generation circuit 200 according to the second embodiment of the present technology. The reference voltage generation circuit 200 according to the second embodiment is different from that according to the first embodiment in further including a p-type transistor 221 and switches 222 and 223. The p-type transistor 221 is connected in parallel with a p-type transistor 213.

The switch 222 controls the p-type transistor 221 to an on state according to setting information held in the register 120. The switch 223 controls the p-type transistor 213 to an on state according to the setting information. The setting information includes two bits that specify a transistor to be turned on between the p-type transistors 213 and 221. Note that a circuit including the switches 222 and 223 is an example of a switch circuit recited in the claims.

When the number of p-type transistors to be turned on is changed according to the setting information, it is possible to adjust combined resistance of on-resistors of the transistors and correct deviation of the reference voltage Vref from a design value. For example, the setting information is changed by user operation or execution of an application so as to reduce the deviation of the reference voltage Vref from the design value.

Note that, although the number of p-type transistors connected in parallel is two, three or more p-type transistors can be connected in parallel to adjust combined resistance thereof.

As described above, according to the second embodiment of the present technology, the combined resistance of the p-type transistors 221 and 222 connected in parallel is adjusted. Therefore, it is possible to correct the deviation of the reference voltage Vref from the design value caused by the product variation between the on-resistors of the p-type transistors.

3. Application Examples

The technology according to the present disclosure is applicable to a technology referred to as so-called the "Internet of things" (IoT). The IoT is a mechanism in which an IoT device 9100, which is a "thing", is connected to another IoT device 9003, the Internet, a cloud 9005, and the like, and those elements control each other by exchanging information. The IoT can be used in various industries such as agriculture, homes, vehicles, manufacturing, distribution, and energy.

Figure 8:
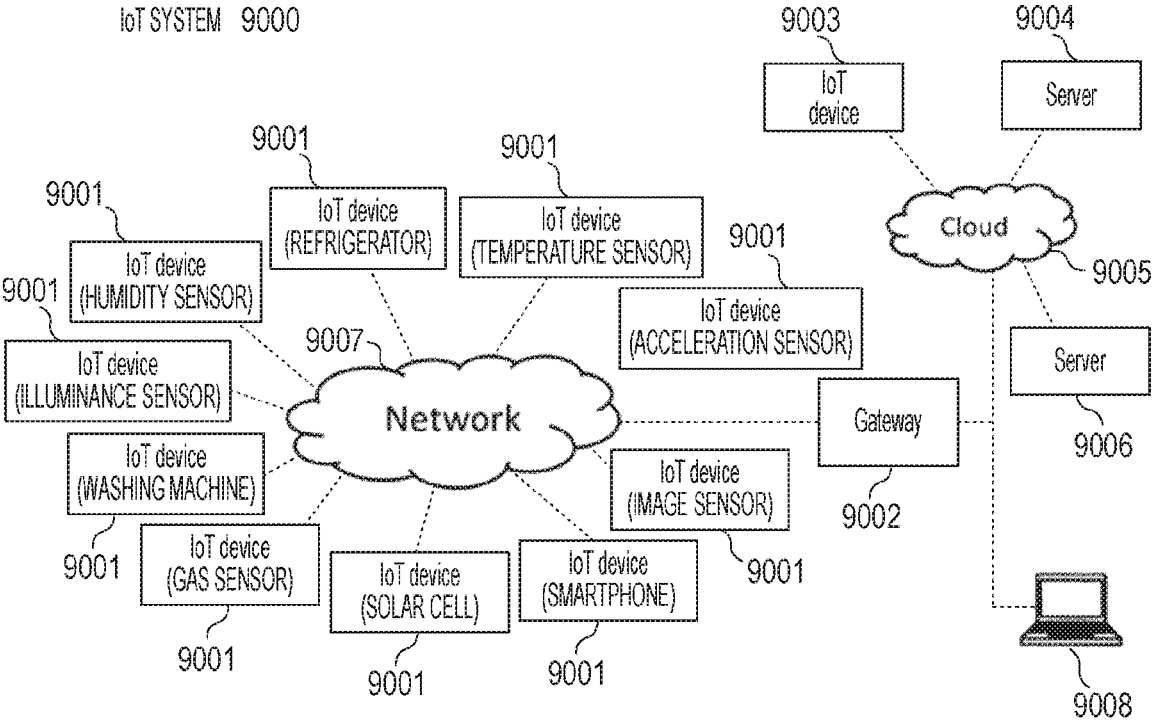
FIG. 8 illustrates an example of a schematic configuration of an IoT system 9000 to which the technology according to the present disclosure is applicable.

FIG. 8 illustrates an example of a schematic configuration of an IoT system 9000 to which the technology according to the present disclosure is applicable.

The IoT device 9001 includes various sensors and the like, such as a temperature sensor, a humidity sensor, an illuminance sensor, an acceleration sensor, a distance sensor, an image sensor, a gas sensor, and a motion sensor. Further, the IoT device 9001 may include terminals such as a smartphone, a mobile phone, a wearable terminal, and a game console. Power is supplied to the IoT devices 9001 by an AC power supply, a DC power supply, a battery, a non-contact power supply, a so-called energy harvesting, or the like. The IoT devices 9001 can communicate by wired or wireless communication, short-range wireless communication, or the like. As a communication method, 3G/LTE, WiFi, IEEE802.15.4, Bluetooth, Zigbee (registered trademark), Z-Wave, or the like is suitably used. The IoT devices 9001 may communicate while switching a plurality of those communication means.

The IoT devices 9001 may form a one-to-one, star, tree, or mesh network. Each IoT device 9001 may be connected to an external cloud 9005 either directly or through a gateway 9002. The IoT device 9001 is given an address by IPv4, IPv6, 6LoWPAN, or the like. Data collected from the IoT device 9001 is transmitted to another IoT device 9003, a server 9004, the cloud 9005, and the like. A timing and frequency of transmitting data from the IoT device 9001 are suitably adjusted, and the data may be compressed and transmitted. Such data may be used as it is, or the data may be analyzed by a computer 9008 by various means such as statistical analysis, machine learning, data mining, cluster analysis, discriminant analysis, combination analysis, and time series analysis. By using such data, it is possible to provide various services such as control, warning, monitoring, visualization, automation, and optimization.

The technology according to the present disclosure is also applicable to devices and services related to a home. The IoT device 9001 in a home includes a washing machine, a dryer, a hair dryer, a microwave oven, a dishwasher, a refrigerator, an oven, a rice cooker, a cookware, a gas appliance, a fire alarm, a thermostat, an air conditioner, a television, a recorder, audio equipment, lighting equipment, a water heater, a boiler, a vacuum cleaner, an electric fan, an air purifier, a security camera, a lock, a door and shutter opener, a sprinkler, a toilet, a thermometer, a scale, a sphygmomanometer, and the like. Further, the IoT device 9001 may include a solar cell, a fuel cell, a storage battery, a gas meter, a power meter, and a distribution board.

A communication method of the IoT devices 9001 in a home is desirably a low power consumption communication method. Further, the IoT devices 9001 may communicate by WiFi indoors and by 3G/LTE outdoors. An external server 9006 for controlling the IoT devices may be installed on the cloud 9005 to control the IoT devices 9001. Each IoT device 9001 transmits data such as a state of a home appliance, a temperature, humidity, power consumption, and presence or absence of a person and animal inside and outside a house. The data transmitted from the home appliance is accumulated in the external server 9006 through the cloud 9005. On the basis of such data, a new service is provided. Such an IoT device 9001 can be controlled by voice by using a voice recognition technology.

Further, states of various home appliances can be visualized by directly transmitting information from the various home appliances to a television. Furthermore, the various sensors determine the presence or absence of a resident and transmit data to an air conditioner, lighting, and the like, thereby turning on/off power supplies thereof. Still further, it is possible to display advertisements on displays included in various home appliances through the Internet.

Hereinabove, an example of the IoT system 9000 to which the technology according to the present disclosure is applicable has been described. The technology according to the present disclosure is suitably applicable to the IoT device 9001 among the configurations described above. Specifically, the electronic device 100 of FIG. 1 is applicable to the IoT device 9001. By applying the technology according to the present disclosure to the IoT device 9001, it is possible to reduce noise of the reference voltage Vref and improve operation stability and reliability of the IoT device 9001.

Note that the above embodiment shows an example for embodying the present technology, and the matters in the embodiment and the matters specifying the invention in the claims have a corresponding relationship. Similarly, the matters specifying the invention in the claims and the matters in the embodiment of the present technology expressed by the same names as those in the matters specifying the invention in the claims have a corresponding relationship. However, the present technology is not limited to the embodiments, and can be embodied by applying various modifications to the embodiments within the gist thereof.

Note that the effects described in this specification are merely examples, are not limited, and may have other effects.

Note that the present technology can also have the following configurations.

(1) A reference voltage generation circuit including:

a diode;

a first resistor having both ends connected to one end of the diode and an output signal line;

a transistor having one of both ends connected to the output signal line;

a second resistor connected to another end of the transistor; and a control unit that controls a potential of the another end of the transistor and a potential of the one end of the diode to the same potential.

(2) The reference voltage generation circuit according to (1), in which a ratio of a resistance value of the second resistor to a resistance value of an on-resistor of the transistor substantially matches a ratio of a reference voltage that is a voltage of the output signal line to a difference between the reference voltage and a forward voltage of the diode.

(3) The reference voltage generation circuit according to (1) or (2), in which the transistor includes a transistor including an on-resistor whose resistance value increases as a temperature increases.

(4) The reference voltage generation circuit according to (3), in which a gate-source voltage of the transistor includes a voltage in a linear region.

(5) The reference voltage generation circuit according to any one of (1) to (4), in which a predetermined number of the transistors are connected in parallel between the output signal line and the second resistor.

(6) The reference voltage generation circuit according to (5), further including a switch circuit that controls a specified transistor among the predetermined number of the transistors to an on state.

REFERENCE SIGNS LIST

100 Electronic device
110 Integrated circuit
120 Register
200 Reference voltage generation circuit
211 Power supply
212, 213, 221 P-type transistor
214, 215, 220 Resistor
216 Diode
217 Operational amplifier
218 Capacitor
222, 223 Switch
9001 IoT device

The invention claimed is:

1. A reference voltage generation circuit, comprising:
a diode;
a first resistor, wherein a first end of the first resistor is connected to an output signal line and a second end of the first resistor is connected to a first end of the diode;
a transistor, wherein a first end of the transistor is connected to the output signal line;
a second resistor, wherein a first end of the second resistor is connected to a second end of the transistor; and
a control unit configured to control a potential of the second end of the transistor and a potential of the first end of the diode, wherein
the potential of the second end of the transistor and the potential of the first end of the diode are controlled to obtain same potential, and
the second end of the transistor is connected to a non-inverting input terminal of the control unit and the first end of the diode is connected to an inverting input terminal of the control unit.

2. The reference voltage generation circuit according to claim 1, wherein a ratio of a resistance value of the second resistor to a resistance value of an on-resistor of the transistor substantially matches a ratio of a reference voltage that is a voltage of the output signal line to a difference between the reference voltage and a forward voltage of the diode.

3. The reference voltage generation circuit according to claim 1, wherein the transistor includes an on-resistor whose resistance value increases as temperature increases.

4. The reference voltage generation circuit according to claim 3, wherein a gate-source voltage of the transistor includes a voltage in a linear region.

5. The reference voltage generation circuit according to claim 1, wherein a specific number of transistors are connected in parallel between the output signal line and the second resistor.

6. The reference voltage generation circuit according to claim 5, further comprising a switch circuit configured to control a specific transistor among the specific number of the transistors to an on state.

7. A reference voltage generation circuit, comprising:
a diode;
a first resistor, wherein a first end of the first resistor is connected to an output signal line and a second end of the first resistor is connected to a first end of the diode;
a transistor, wherein a first end of the transistor is connected to the output signal line;
a second resistor, wherein
a first end of the second resistor is connected to a second end of the transistor,
a ratio of a resistance value of the second resistor to a resistance value of an on-resistor of the transistor substantially matches a ratio of a reference voltage to a difference between the reference voltage and a forward voltage of the diode, and
the reference voltage is a voltage of the output signal line; and
a control unit configured to control a potential of the second end of the transistor and a potential of the first end of the diode, wherein the potential of the second end of the transistor and the potential of the first end of the diode are controlled to obtain same potential.

8. A reference voltage generation circuit, comprising:
a diode;
a first resistor, wherein a first end of the first resistor is connected to an output signal line and a second end of the first resistor is connected to a first end of the diode;
a transistor, wherein
a first end of the transistor is connected to the output signal line, and
the transistor includes an on-resistor whose resistance value increases as temperature increases;
a second resistor, wherein a first end of the second resistor is connected to a second end of the transistor; and
a control unit configured to control a potential of the second end of the transistor and a potential of the first end of the diode, wherein the potential of the second end of the transistor and the potential of the first end of the diode are controlled to obtain same potential.

* * * * *